US005160459A

United States Patent [19]

Guarnaschelli et al.

[11] Patent Number: 5,160,459

[45] Date of Patent: Nov. 3, 1992

[54] FLUID MIXER

[76] Inventors: Claudio Guarnaschelli; Marco G. Guarnaschelli, both of 5583 Spruce Street, Burnaby, Canada, V5C 1Y7

[21] Appl. No.: 818,508

[22] Filed: Jan. 8, 1992

Related U.S. Application Data

[63] Continuation of Ser. No. 618,760, Nov. 27, 1990, abandoned.

[51] Int. Cl.[5] ..... B01F 3/04; B01F 5/10

[52] U.S. Cl. ..... 261/92

[58] Field of Search ..... 261/87

[56] References Cited

U.S. PATENT DOCUMENTS

| | | | |
|---|---|---|---|
| 1,526,596 | 2/1925 | Greenawalt | 261/87 |
| 3,210,053 | 10/1965 | Boester | 261/87 |
| 3,490,996 | 1/1970 | Kelly, Jr. | 261/87 |
| 3,864,438 | 2/1975 | Nagahara | 261/87 |
| 4,297,214 | 10/1981 | Guarnaschelli | 210/220 |

FOREIGN PATENT DOCUMENTS

| | | | |
|---|---|---|---|
| 1189952 | 4/1965 | Fed. Rep. of Germany | 261/87 |
| 3407834 | 9/1984 | Fed. Rep. of Germany | 261/87 |
| 204038 | 11/1983 | German Democratic Rep. | 261/87 |
| 7108614 | 12/1972 | Netherlands | 261/87 |
| 7614453 | 12/1976 | Netherlands | 261/87 |
| 871945 | 7/1961 | United Kingdom | 261/87 |

*Primary Examiner*—Tim Miles

*Attorney, Agent, or Firm*—Townsend and Townsend

[57] ABSTRACT

A fluid mixer for submerging within a body of liquid to transfer and mix the fluid in the body of liquid. The mixer does not draw liquid through an opening and has no sharp corners so debris within the body of liquid cannot plug the mixer. The apparatus comprises a rotatable shaft with a hollow passage and a fluid intake to the hollow passage. An impeller is attached to the end of the shaft. The impeller has two circular discs, substantially the same diameter. The discs are coaxial with the shaft and have a space therebetween. The hollow passage within the shaft is in communication with the space between the discs. A plurality of impeller blades are spaced apart about the impeller and extend outwards from the space between the discs.

3 Claims, 3 Drawing Sheets

13
12
25
26
24
18
21
20
2
16
14
10
2

16
30
14
32
40
34
42
36
38

FLUID MIXER

This is a continuation of Ser. No. 07/618,760 filed Nov. 27, 1990, now abandoned.

BACKGROUND OF THE INVENTION

The present invention relates to an apparatus for transferring and mixing a fluid, such as a liquid or a gas, into a body of liquid. More specifically the present invention relates to a fluid mixer to be submerged within a body of liquid wherein fluid is mixed with the liquid.

Mixing impellers submerged within a body of water are well known. Even mixing impellers having a hollow tube wherein air or gas is drawn or blown down the tube for mixing within a body of liquid are known. In the past, an impeller rotates and draws air down through a hollow shaft and mixes it with liquid which is agitated by the impeller. An example of such an aerator is disclosed in my U.S. Pat. No. 4,297,214. Whereas the impeller worked well in most environments, when it was used in sewage or other unfavorable environments containing debris, the impeller blades tended to lag or plug up because the liquid containing debris was drawn through the impeller blades.

SUMMARY OF THE INVENTION

It is the aim of the present invention to provide a fluid mixer for insertion in the body of liquid which has an impeller at the end of a hollow shaft and draws fluid, either a gas or a liquid, down through the hollow shaft, passes it through the impeller to mix in the body of the liquid. The impeller of the present invention does not draw liquid from the body of liquid through it. Only the fluid drawn down the hollow shaft passes through the impeller. External blades on the impeller are, inter alia, used to agitate or mix the liquid surrounding the impeller and this avoids clogging or plugging problems when the impeller is used in sewage and like environments.

The fluid mixer of the present invention may be used for regulated biological activities in nitrogen and phosphorous removal, high temperature thermophilic reactions, fermentation processes, gas and liquid transfers and mixing in chemical processings.

It is the aim of the present invention to provide a mixer which draws more fluid into an impeller, has increased mixing efficiency, and is able to work in a non-homogeneous liquid environment containing debris.

The present invention provides an apparatus for mixing fluid in a liquid comprising a rotatable shaft with a hollow passage therein, a motor means for rotating the shaft, a fluid intake to the hollow passage in the shaft, an impeller attached to an end of the shaft, the impeller having two circular discs with substantially the same diameter, the discs coaxial with the shaft and having a space there between, the hollow passage within the shaft in communication with the space between the discs, and plurality of impeller blades spaced apart about the impeller and extending outwards from the space between the discs.

BRIEF DESCRIPTION OF THE DRAWINGS

In drawings which illustrate embodiments of the invention.

DESCRIPTION OF THE PREFERRED EMBODIMENTS

Figure 1:
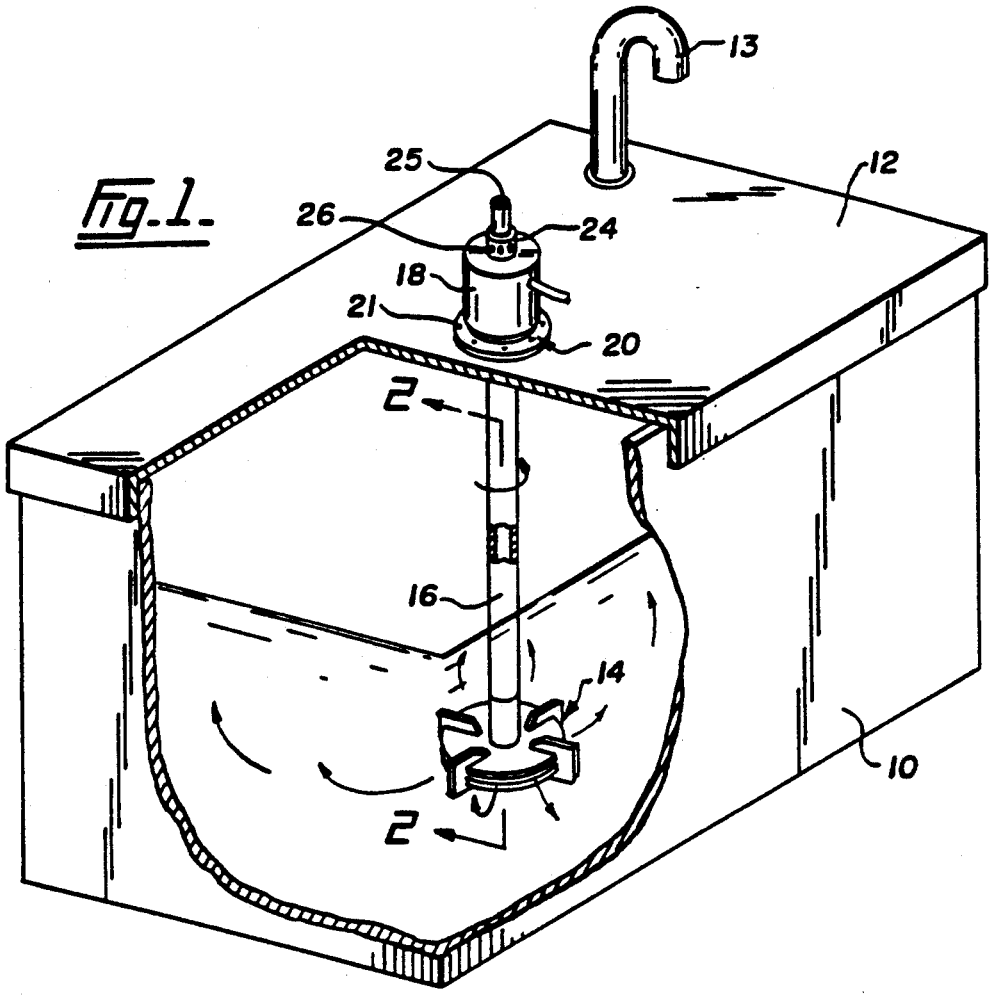
FIG. 1 is an isometric view of a fluid mixer in a sewage tank.

In the illustrated embodiments, FIG. 1 shows a tank 10 containing a body of liquid and having a cover 12 with a vent 13 therein. The tank may be a sewage tank or a tank or vessel used for mixing in a chemical process or the like. An impeller 14 attached to a shaft 16 is positioned in the tank 10. The shaft 16 is hollow and is attached at its top to a motor 18 having a flange 20 thereon attached by bolts 21 to the cover 12 on the tank 10. The motor 18 is a hollow shaft motor and has a sleeve 24 which fits over the hollow shaft 16. A set screw 26 holds the sleeve 24 to the shaft 16.

At the top of the hollow shaft 16 is an opening 25 for air, gas, liquid or other types of fluid to be drawn down the hollow shaft 16 or pumped down the shaft 16 feeding to the impeller 14. A rotating union (not shown) may be attached to the top of the shaft 16 for connection to another pipe fitting. Alternatively a chamber and seal (not shown) may also be provided on the top of the shaft 16 for connection to any desired fluid supply.

Figure 2:
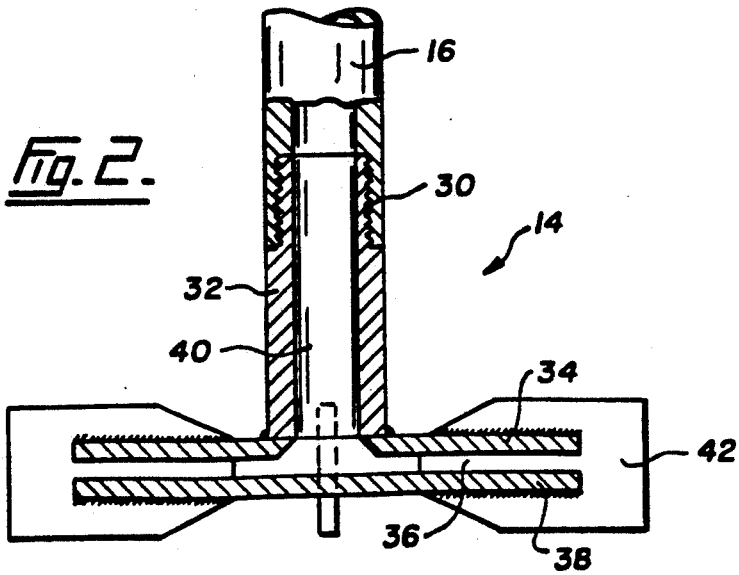
FIG. 2 is a sectional view taken at line 2—2 of FIG. 1.

As shown in FIG. 2 the connection between the shaft 16 and the impeller 14 is a threaded connection 30. The top of the impeller 14 has a stub shaft 32 which is welded to a top circular disc 34. A space 36 is provided between the top disc 34 and bottom disc 38, the space 36 being connected to the hollow portion 40 of the stub shaft 32 which in turn is connected to the hollow portion of the shaft 16. The top circular disc 34 and the bottom circular disc 38 are approximately the same diameter. Impeller blades 42 are positioned about the two discs 34 and 38 and extend into the space 36.

The impeller 14 performs two main functions, that of aspirator and mixer. In its aspirating function a venturi effect creates a vacuum, or region of low pressure, behind the blades 42. This low pressure draws the fluid from inside the impeller 14 and the shaft 16. As a mixer, the impeller generates turbulent flow and high shear to generate small bubbles, thus greatly facilitating the mixing of gas and liquid. In addition, violent agitation of the liquid within the container 10 is also provided by blades 42. Because the blades 42 are mainly external to the discs 34 and 38, there is no clogging, as in the prior art. The aspiration function means that no compressor or blower is required. The apparatus aspirates gases and liquids. Because of the efficiency as a mixer chemical reactions proceed at a rapid rate. The turbulent flow quickly establishes contact between the reactants and the shear mixing generates a large surface area, which is also desirable for rapidity of chemical reaction and gas transfer.

The mixer may be used for aspirating liquid and/or mixing two liquids together. In both cases a first fluid is drawn down the hollow shaft 16 by the impeller 14. In operation the impeller is rotated and the liquid that surrounds the impeller 14 is propelled radially by the external blades 42 which create a vacuum on the trailing side of the blades 42. At start up, the vacuum draws liquid from the tank 10 that has filled the space 36 between the discs 34 and 38, the hollow portion 40 of the short stem 32, and the hollow shaft 16 to the liquid level in the tank 10. When liquid that has been in these areas is drawn out by means of a vacuum from the blades 42 then fluid is drawn down the hollow shaft 16 and passes out in the space 36 between the discs 34 and 38 to mix with the liquid in the tank 10. The quantity of fluid drawn down through the hollow shaft 16 is directly proportional to the horsepower applied to the impeller.

The portion of the blade 42 that is within the space 36 between the discs 34 and 38, acts as a fan blade to force the gas or liquid being drawn down the hollow shaft 16 out of the space 36. Thus the impeller blades 42 agitate and mix the liquid in the tank 10 and simultaneously create a vacuum or reduced pressure at their trailing sides to pull gas or liquid down the hollow shaft 16 and blow gas or pump liquid out of the periphery of the impeller 14 as described above.

Figure 3:
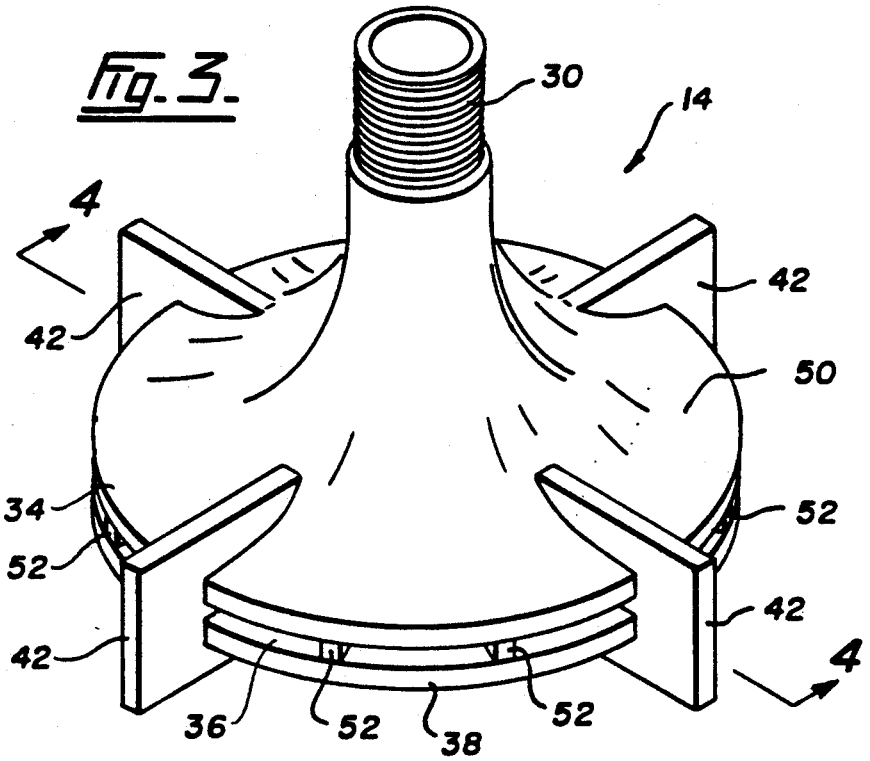
FIG. 3 is an isometric view of one embodiment of an impeller for the fluid mixer of the present invention.
Figure 4:
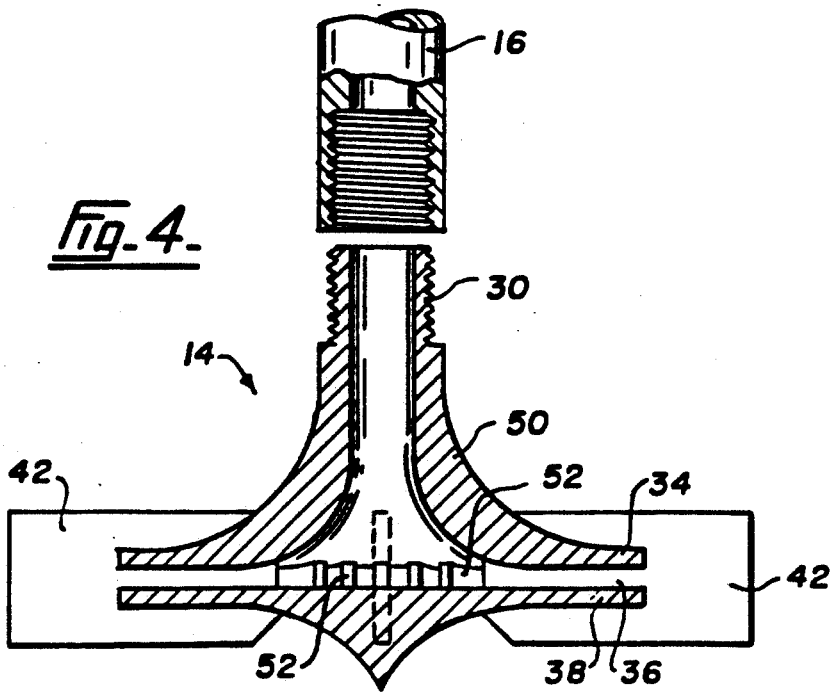
FIG. 4 is a sectional view of the impeller taken at line 4—4 of FIG. 3.

Another embodiment of an impeller is shown in FIGS. 3 and 4. The embodiment of FIGS. 3 and 4 has curved surfaces to provide a more aerodynamic flow of gas down the hollow shaft 16, into the space 36 between the discs 34 and 38 and out through the impeller 14. The impeller has a streamlined external configuration with no sharp corners where debris can collect. The top portion 50 of the impeller 14 has a threaded section 30 to mate with the internal threads of the hollow shaft 16 and has radiused internal and external curved surfaces integrally formed with the top disc 34. Impeller blades 42 are radially positioned equidistance apart about the perimeter of the discs 34 and 38. The blades 42 extend out beyond the periphery of the discs. Additional internal blades 52 are spaced between the external blades 42, positioned in the space 36 between the discs 34 and 38 to facilitate flow.

The internal blades 52 may be integrally welded or molded with the discs 34 and 38 made out of metal, plastic or other suitable material. Alternatively, they may be welded in place for the configuration illustrated in FIG. 2. In this configuration they assist in holding the bottom disc 38 in place to form the impeller assembly 14.

Figure 5:
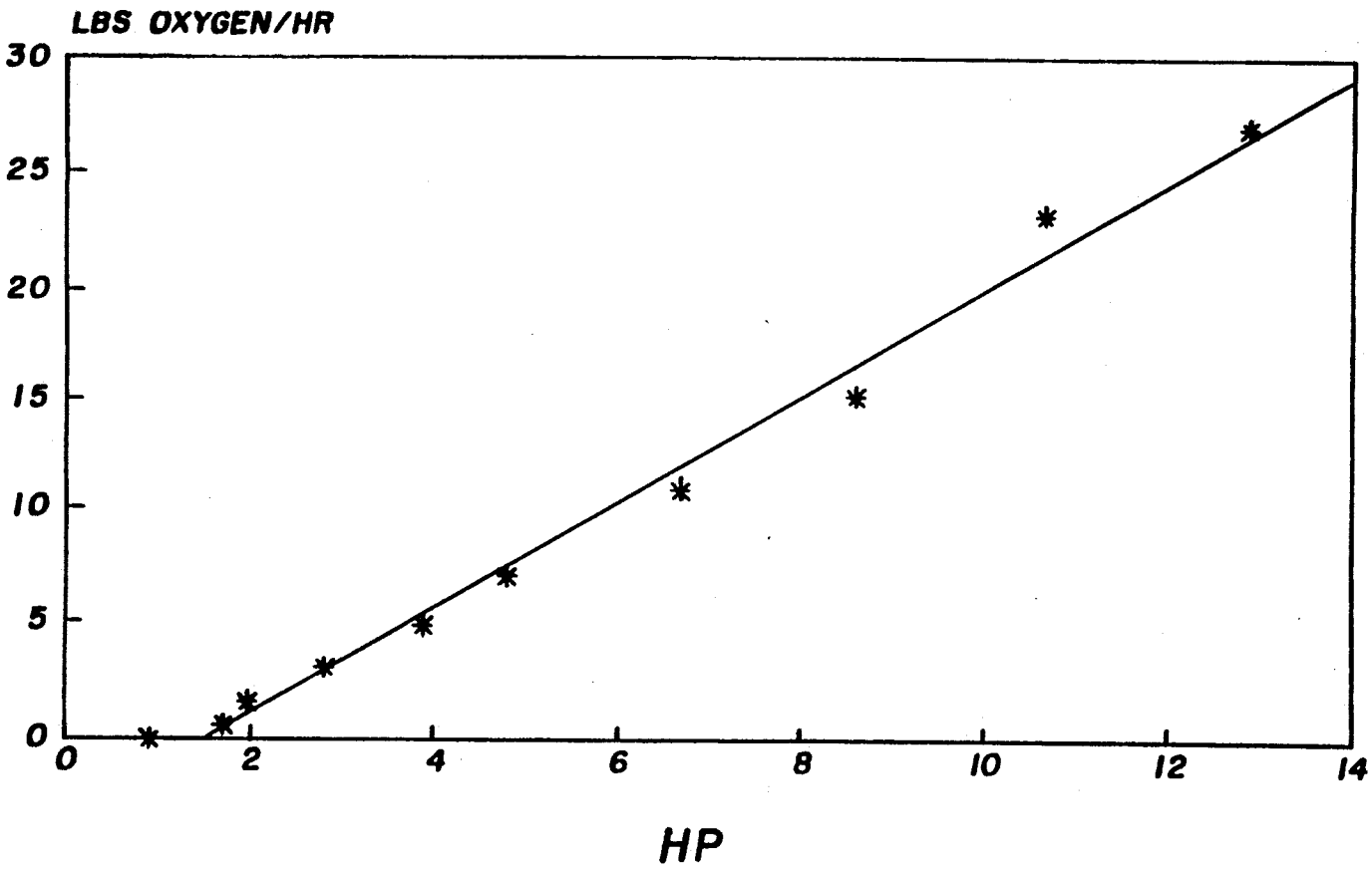
FIG. 5 is a graph showing the relationship between oxygen transfer and horsepower.

The linear relationship between gas transfer to a liquid and the horsepower of the motor is illustrated in FIG. 5 for the case of oxygen and water.

As is the case for blades 42 in FIGS. 1 and 2, the high shear of the rotating blades 52 develops many small gas bubbles which results in high gas transfer from the indrawn gas to the liquid. The transfer rate of oxygen by air/water interface was determined using the unsteady state method described in the Water Pollution Control Federation Manual of Practice No. 5 published 1971 at page 19, the disclosure of which is incorporated herein by reference.

The external portion of the blades 42, placed radially around the discs 34 and 38, have no sharp corners. Thus any debris present in the liquid in the tank 10, e.g., plastic, string, hair, etc. slides away from the blades 42 during rotation and does not interfere with the aspirating functions of the impeller.

Whereas the impeller is shown mounted with a substantially vertical axis, it could be placed at an angle for directional flow. The blades 42 are shown to be parallel to the axis of the impeller and these too could be turned one way or the other so the impeller may be used for directional flow. The blades 42 may also be curved.

Various changes may be made to the embodiments shown herein without departing from the scope of the present invention which is limited only by the following claims.

We claim:

1. An apparatus for drawing fluid into a liquid and subsequently mixing the fluid in the liquid comprising:

a rotatable shaft with a hollow passage therein;

an axial fluid intake to the hollow passage at a top end of the shaft;

an electric motor for rotating the shaft, the motor having a rotatable hollow drive sleeve fitting over the shaft with connection means between the sleeve and the shaft;

mounting means for the electric motor for supporting the motor permitting the shaft to rotate;

an impeller attached to a bottom end of the shaft, the impeller having two circular discs of substantially the same diameter, the discs coaxial with the shaft and having a space therebetween, the hollow passage within the shaft in communication with the space between the discs;

a plurality of external radial impeller blades equally spaced apart around the two circular discs, the external blades projecting above and below the two circular discs and tapering inwards to join the external faces of the discs with no sharp corners, and extending outwards from the space between the discs, and a plurality of internal radial impeller blades, interspaced between the external radial impeller blades located in the space between the discs.

2. The apparatus according to claim 1 wherein the hollow drive sleeve is axially adjustable on the shaft.

3. The apparatus according to claim 1 wherein the hollow passage in the rotatable shaft joins to the space between the discs by means of a smooth curved internal shoulder in the impeller to provide aerodynamic flow for fluid passing through the hollow passage to the space between the discs.

* * * * *